US006378253B1

(12) United States Patent
Richardson

(10) Patent No.: US 6,378,253 B1
(45) Date of Patent: Apr. 30, 2002

(54) GLAZED STRUCTURES

(75) Inventor: Christopher Richardson, Clitheroe (GB)

(73) Assignee: Ultraframe (UK) Limited, Clitheroe (GB)

( * ) Notice: Subject to any disclaimer, the term of this patent is extended or adjusted under 35 U.S.C. 154(b) by 0 days.

(21) Appl. No.: 09/360,325

(22) Filed: Jul. 23, 1999

(51) Int. Cl.[7] ..... E06B 1/60

(52) U.S. Cl. ..... 52/204.5; 52/212; 52/210; 52/213; 52/204.55; 52/204.7; 52/656.5

(58) Field of Search ..... 52/204.5, 212, 52/213, 209, 204.1, 204.55, 204.62, 204.7, 204.61, 210, 656.4, 656.5, 656.6, 756.3; 49/467

(56) References Cited

U.S. PATENT DOCUMENTS

| | | | | | |
|---|---|---|---|---|---|
| 2,875,481 | A | * | 3/1959 | Erkkila | 52/210 |
| 2,898,642 | A | * | 8/1959 | Etling | 52/210 |
| 3,042,160 | A | * | 7/1962 | Price | 52/212 |
| 3,274,735 | A | * | 9/1966 | Stackhouse | 52/204.1 |
| 3,310,920 | A | * | 3/1967 | Bell et al. | 52/210 |
| 3,340,665 | A | * | 9/1967 | Kohl | 52/656.6 |
| 3,490,178 | A | * | 1/1970 | Voisin | 52/204.1 |
| 3,526,074 | A | * | 9/1970 | Miller | 52/207 X |
| 4,038,791 | A | | 8/1977 | Atkinson | |
| 4,237,664 | A | * | 12/1980 | Wilmes | 52/209 |
| 4,411,104 | A | * | 10/1983 | Aubin | 49/470 |
| 4,624,091 | A | * | 11/1986 | Biro | 52/656.5 |
| 4,627,202 | A | * | 12/1986 | Esposito | 52/209 |
| 4,689,933 | A | * | 9/1987 | Biro | 52/656.5 |
| 4,843,787 | A | * | 7/1989 | Pierson | 52/204 |
| 4,884,376 | A | | 12/1989 | DeBlock et al. | |
| 4,899,507 | A | * | 2/1990 | Mairlot | 52/222 |
| 4,956,940 | A | * | 9/1990 | Touton, III | 49/388 |
| 5,036,637 | A | | 8/1991 | Biebuyck | |
| 5,293,723 | A | * | 3/1994 | Slessor | 52/213 |
| 5,325,633 | A | * | 7/1994 | Magoon | 49/504 |
| 5,341,600 | A | * | 8/1994 | Heppner | 52/207 X |
| 5,524,391 | A | * | 6/1996 | Joffe et al. | 49/468 |
| 5,651,223 | A | * | 7/1997 | Novak et al. | 52/211 |
| 5,956,909 | A | * | 9/1999 | Chou | 52/209 |
| 6,006,478 | A | * | 12/1999 | Hubner et al. | 52/656.5 X |
| 6,032,423 | A | * | 3/2000 | Takemura et al. | 52/235 |
| 6,098,355 | A | * | 8/2000 | Li | 52/212 |

FOREIGN PATENT DOCUMENTS

| | | | | |
|---|---|---|---|---|
| DE | 295 03 398 U | | 4/1995 | |
| DE | 195 24 612 A | | 1/1997 | |
| GB | 755003 | | 8/1956 | |
| GB | 907626 | | 10/1962 | |
| GB | 1 395 086 | | 5/1975 | |
| GB | 1513798 | | 6/1978 | |
| GB | 1574716 | | 9/1980 | |
| GB | 2115037 A | | 9/1983 | |
| GB | 2161192 A | * | 1/1986 | 52/656.5 |
| GB | 2223772 A | | 4/1990 | |

* cited by examiner

*Primary Examiner*—Carl D. Friedman
*Assistant Examiner*—Phi Dieu Tran A
(74) *Attorney, Agent, or Firm*—Rockey, Milnamow & Katz, Ltd.

(57) ABSTRACT

A system for forming a glazed structure, such as a wall of a conservatory or sun room, comprising a base member, support posts mountable on the base member and capable of receiving on at least one side a window frame and an eaves beam mountable on the support posts.

11 Claims, 9 Drawing Sheets

GLAZED STRUCTURES

TECHNICAL FIELD OF THE INVENTION

This invention concerns glazed structures and, in particular, concerns glazed structures for forming walls of conservatories or sunrooms.

BACKGROUND OF THE INVENTION

Conservatory or sun room walls can be formed using load-bearing window frames connected side by side and then adding the glazing to the frames. It may be desirable, however, to form such walls using pre-glazed, non-load-bearing windows. A need has arisen, therefore, for a system whereby such windows can be incorporated into glazed structures, such as in the construction of conservatory walls.

SUMMARY OF THE INVENTION

This invention provides in a building wall, such as a wall of a conservatory or a sun room, a window frame fastened to a support post, which has an inner side, an outer side, and two lateral sides. The support post has a channel extending along one of the inner and outer walls and defining two lateral walls. A fastener, such as a fixing screw, is driven through one of the lateral walls to fasten the window frame adjacent to whichever of the lateral sides is nearer. A plurality of similar fasteners may be similarly used.

Preferably, the support post has a similar channel extending along each of the inner and outer walls, and a fastener is driven through one of the lateral walls of each channel to fasten the window frame to whichever of the lateral sides is nearer. A plurality of similar fasteners may be similarly used. Preferably, two window frames are fastened similarly to the support post, each adjacent to one of the lateral sides of the support post.

Preferably, each channel is configured so that its lateral walls flare outwardly toward the side having the channel. Preferably, each channel is configured so that each of its lateral walls meets the side having said channel at an obtuse angle.

Preferably, the support post is mounted on a base member. Preferably, an eaves beam is mounted on the support post.

The foot plates are preferably attached to the support post bottom ends by means of screws or the like through the foot plates into the support posts, preferably into screw ports formed therein. The support posts are preferably aluminium extrusions. Thus, the same screw port formations may be used for fixing the eaves beam on top of the support posts by means of screws or the like through the eaves beam into said screw ports.

The support posts preferably have on opposite sides spaced flanges between which window frames can be accommodated. Between the opposed sides of the support posts, at least the intended outer ends of the support posts are channelled whereby which screw fixings into the foot plates and window frames can be concealed by cover trims that preferably snap fit over the channels, such as by means of lipped formations on intended internal faces of the trims that locate behind lips along edges of the channels. For larger scale support posts ideally said channels include angled walls through which fixing screws or the like can be driven into adjacent window frames. Different posts may be provided for comers of glazed wall structures, so as to provide for differentcornerangles.

The base member preferably also has means for receiving a weather seal on which window frames will sit, i.e. to prevent drafts or water ingress, or a baffle for ventilation. It is preferred that the shelf support will be outermost and preferably the base member slopes downwardly towards a foot of the shelf. These drainage holes may be provided for water drainage from window frames. The base member may also include ventilation passages, which may be openable or closable from within the structure.

The base member is preferably arranged to receive separable sill members to suit, i.e. depending on the substrate supporting the base member, such as whether it is floor mounted, such as on decking or whether it is mounted on a low wall.

BRIEF DESCRIPTION OF THE DRAWINGS

This invention will now be further described, by way of example only, and with reference the accompanying drawings, in which.

DETAILED DESCRIPTION OF THE ILLUSTRATED EMBODIMENTS

Figure 1:
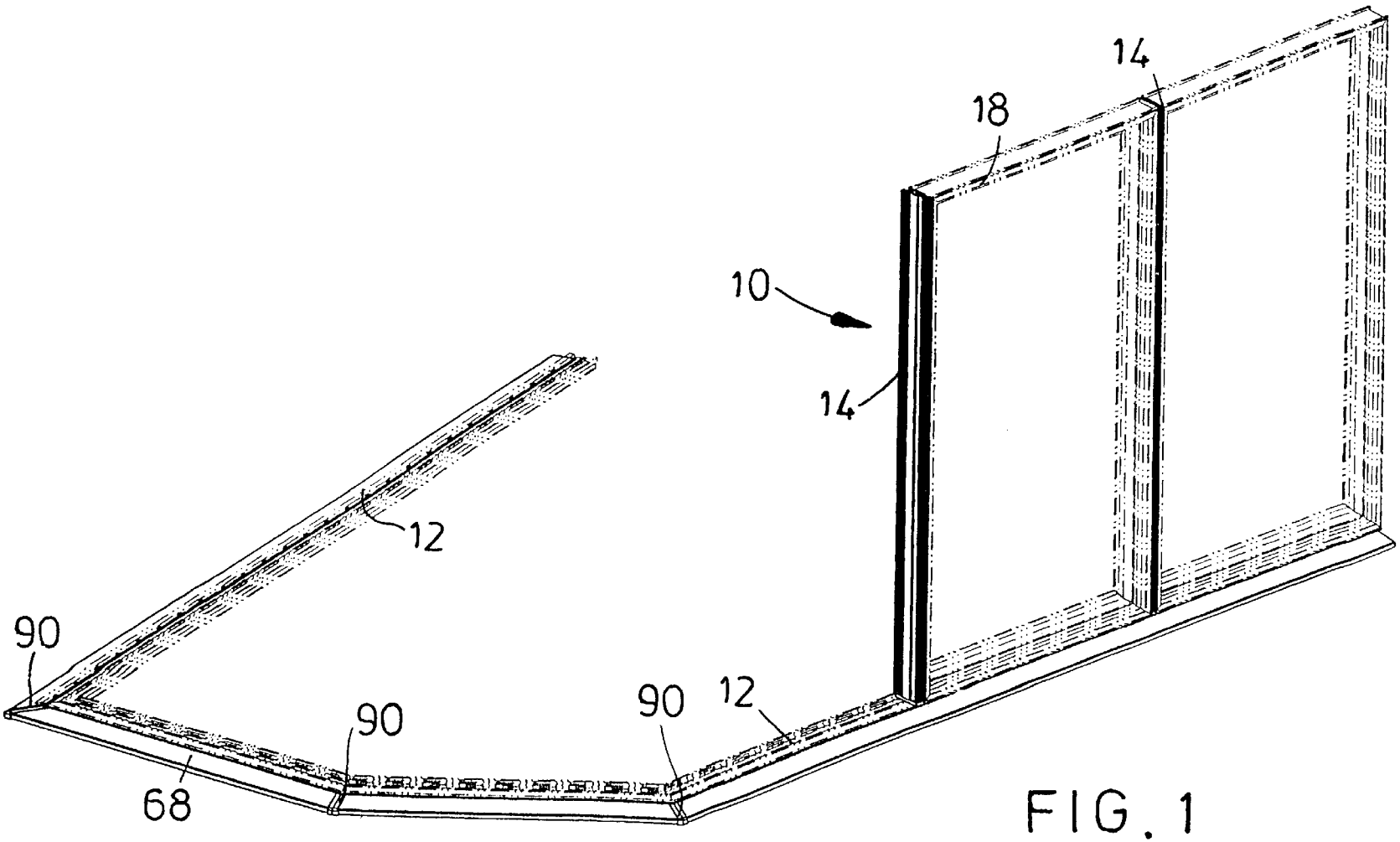
FIG. 1 shows schematically a glazed wall structure according to the invention.

Referring to the accompanying drawings, a glazed wall structure 10 comprises base members 12, which may be mounted on any suitable substrate, such as decking or walls, vertical support posts 14 mounted on the base members and eaves beams 16 (not shown in FIG. 1) mounted on top of the support posts fixed between the support posts 14 are pre-glazed window frames 18.

The eaves beams 16 are generally L-shaped having a base 20 and a twin walled upstand 22 with a head 24 having an arcuate top surface 26. In forming a complete structure, the glazing bars supporting glazing panels will be secured to the head of the eaves beam. The eaves beams 16 also have webs 28, 30 on the outward face for attachment of gutters or gutter brackets and webs 32, 33 on their inner face for attachment of internal cladding (not shown).

Figure 2:
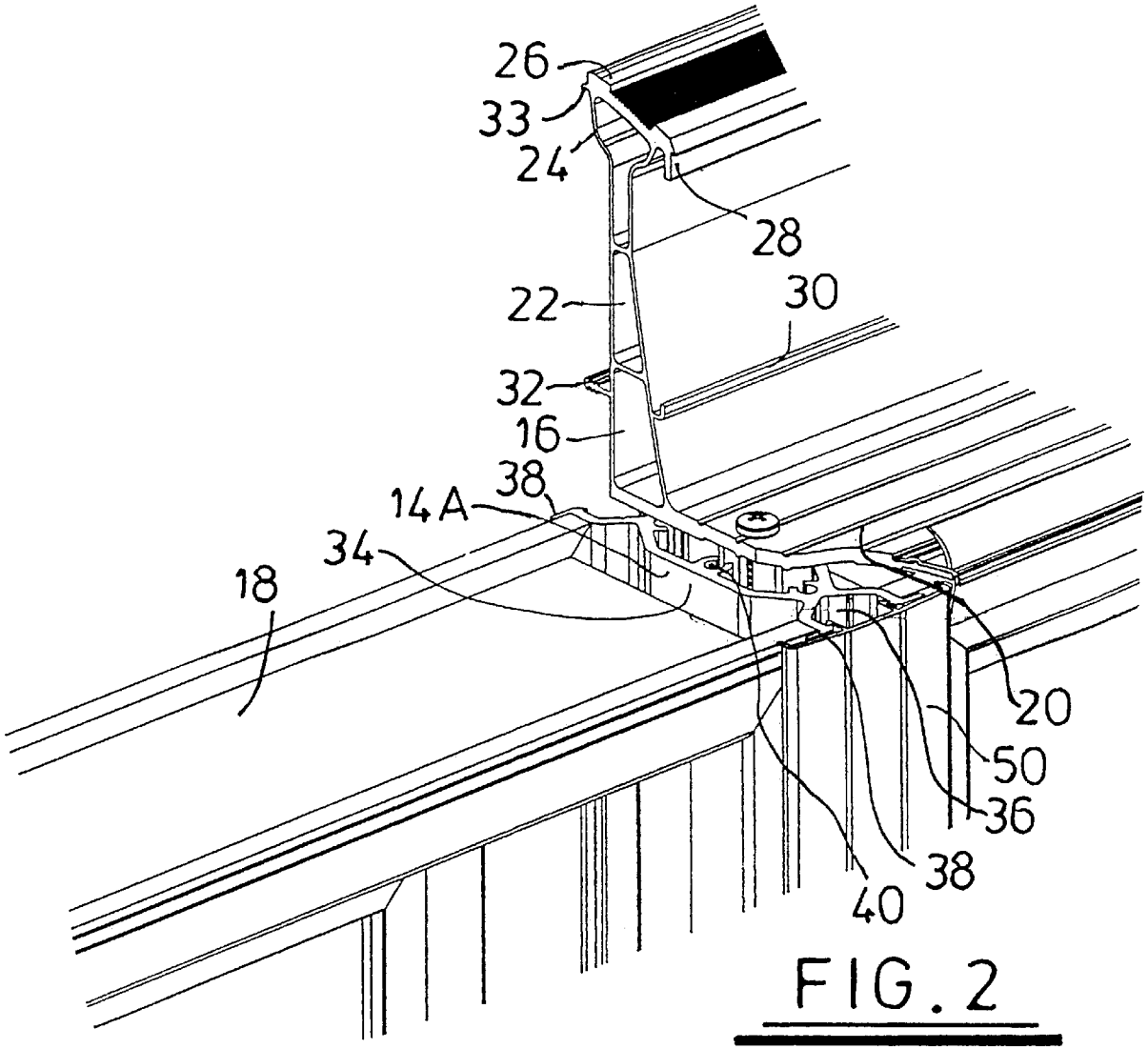
FIG. 2 shows the eaves construction of the type of structure of FIG. 1 using larger scale support posts.
Figure 8:
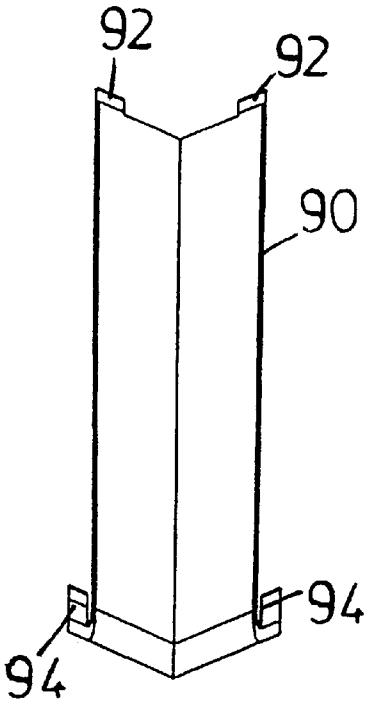
FIGS. 7 and 8 are perspective and isometric top views of a sill component connector.
Figure 3:
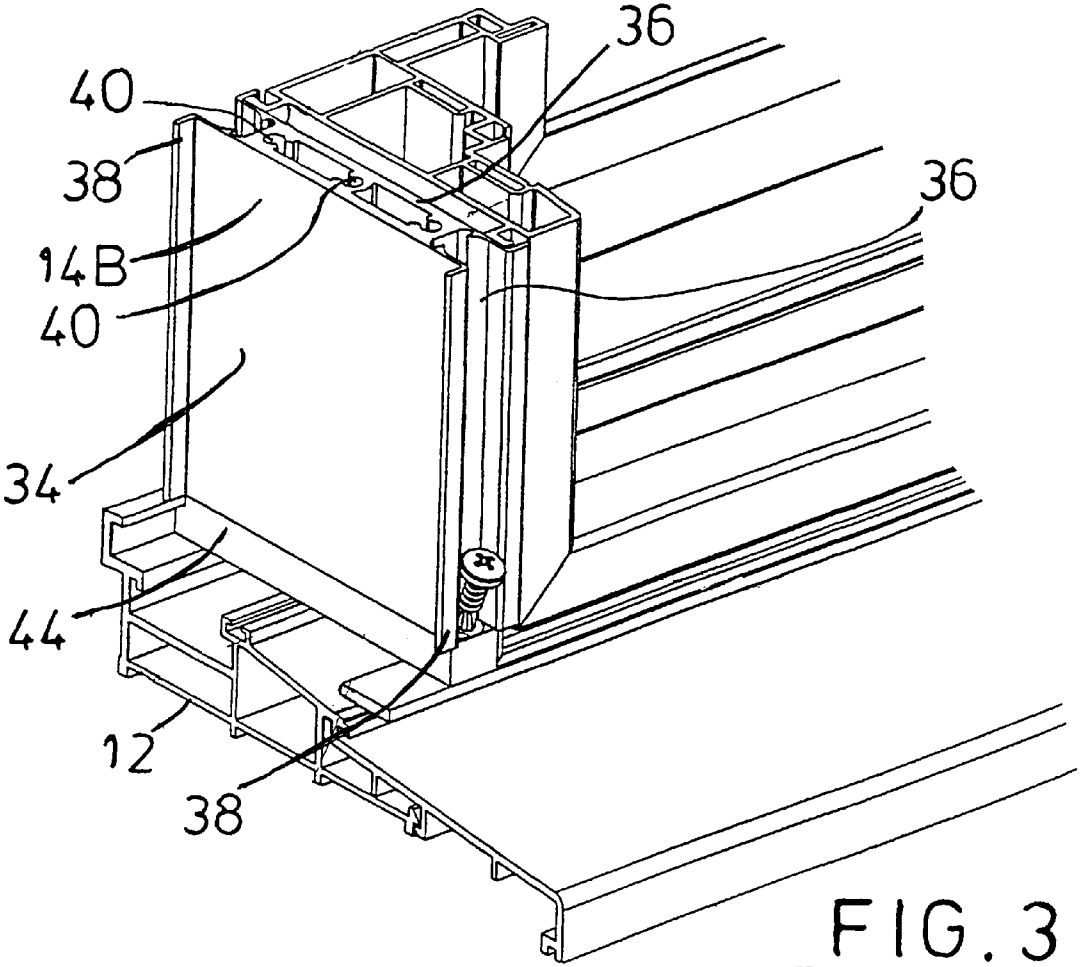
FIG. 3 shows the base construction of the type of structure of FIG. 1 using smaller scale support posts.
Figure 4:
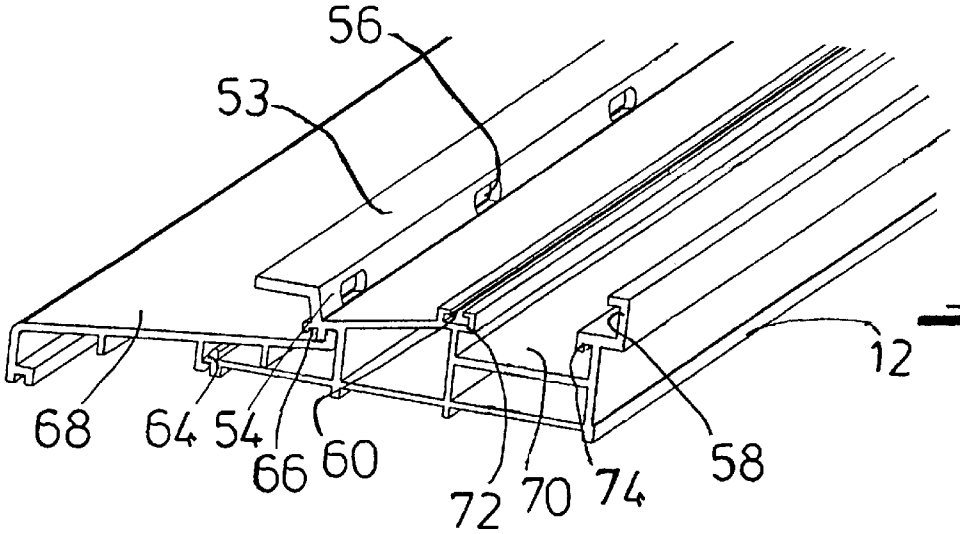
FIG. 4 shows a base member used in the base construction of the structure of FIG. 1.
Figure 7:
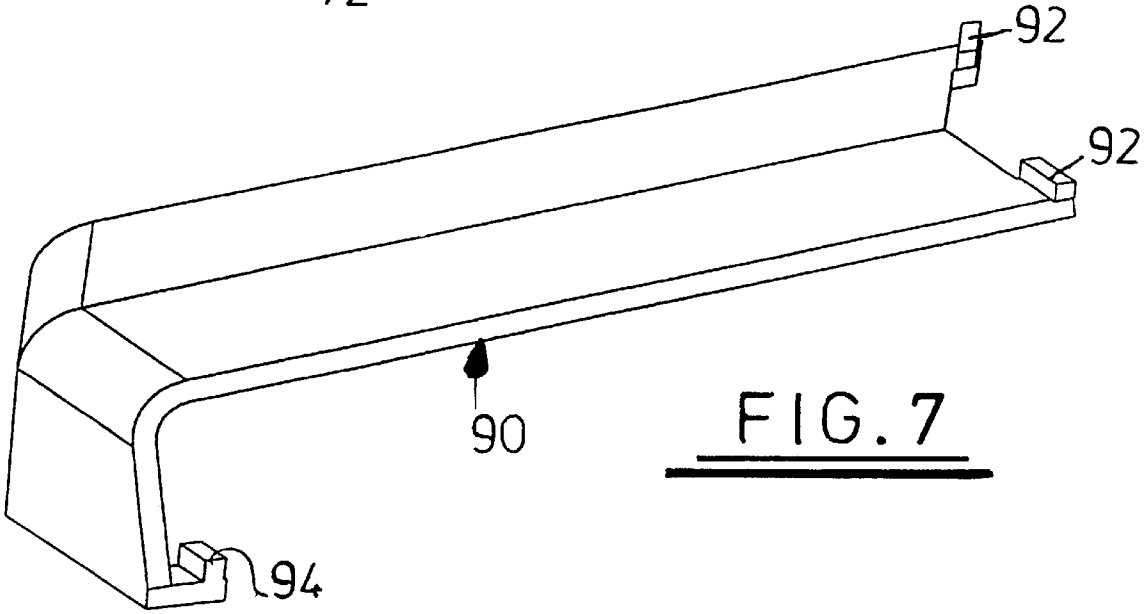
Figure 5:
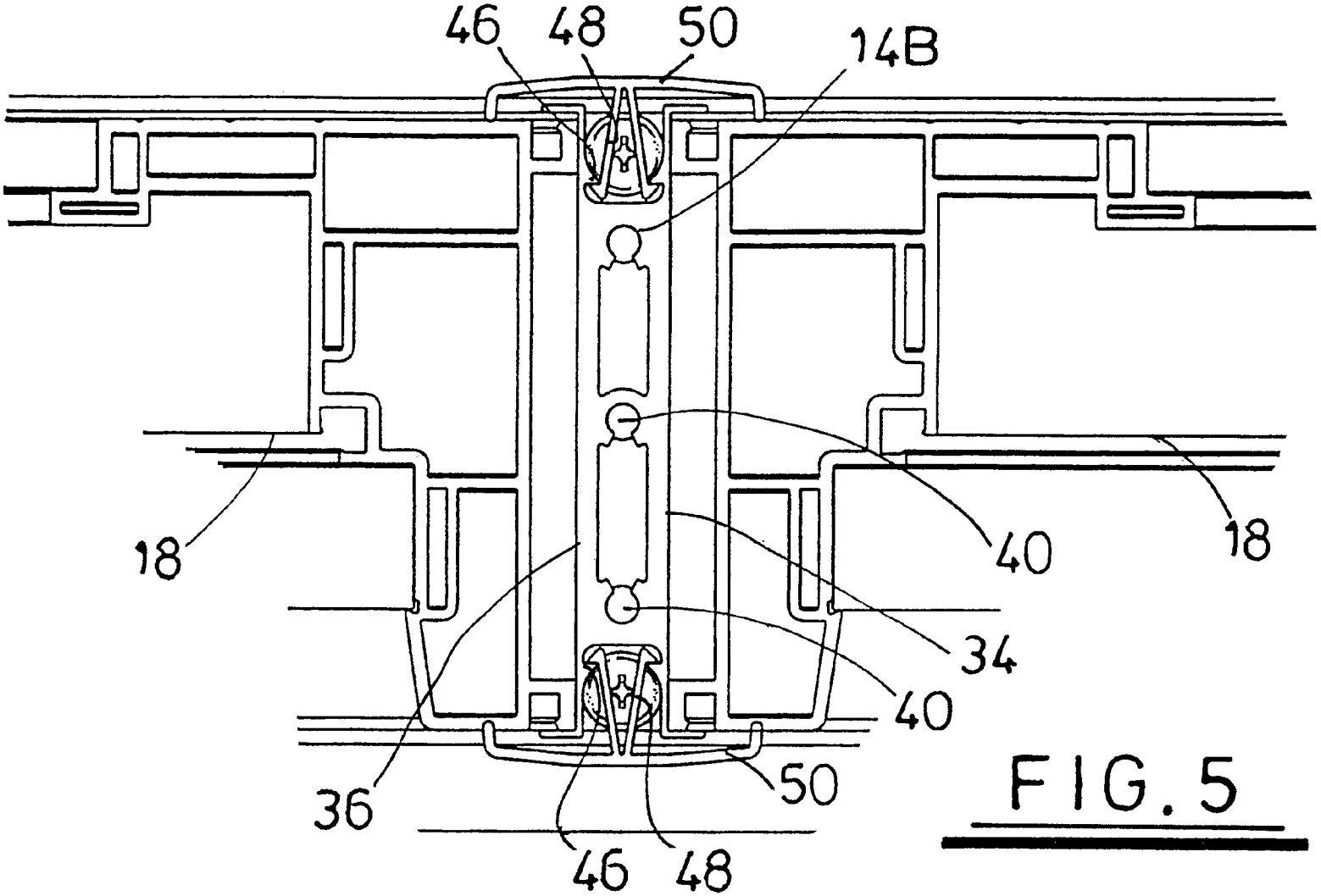
FIG. 5 hows a plan part of the structure of FIG. 3.
Figure 6:
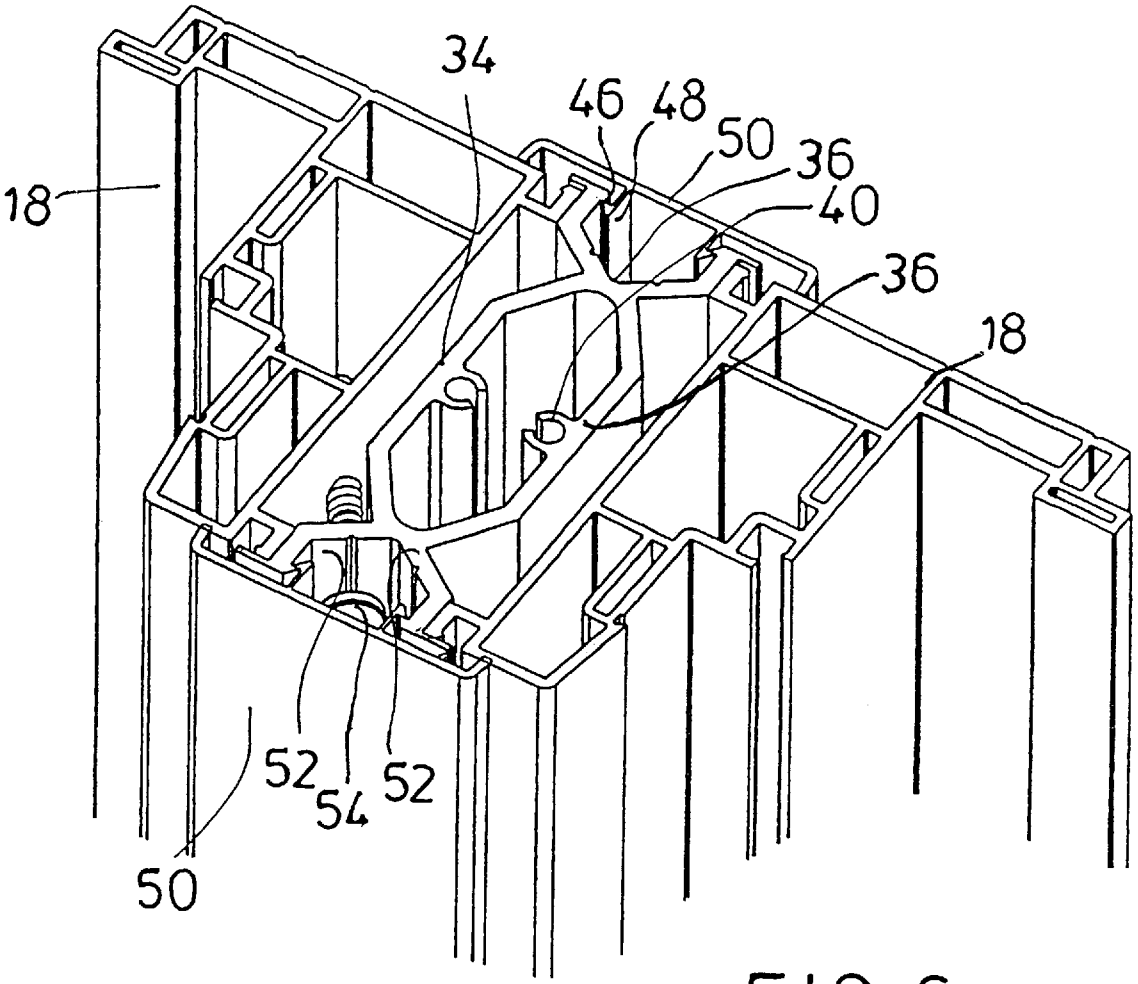
FIG. 6 is a top view from one side of the part of the structure of FIG. 2.

The support posts 14 for in-line securement of window frames shown in the drawings are of two types but have not been shown in both eaves and base constructions, although it will be evident that the description of one will apply to the other. Thus, FIG. 2 shows the eaves construction with a larger scale support post and FIG. 3 shows the base construction with a smaller scale support post.

Supports 14 of both the larger (14A) and smaller (14B) types have opposed sides 34 and ends 36. Extending from both sides at opposite ends thereof are flanges 38 to provide location channels for the window frames 18 to be supported by the support posts. The support posts 14 are formed as hollow aluminium extrusions and have intemally one or more screw ports 40 that can be used from above for securement of eaves beams 16 by means of fixing screws 42 through the eaves beams into the screw ports (see FIG. 2) and from below for securement of foot plates 44 by means of screws upwardly through the foot plates 44 into the screw ports (see FIG. 3).

The ends 36 of the support posts 14 are formed as channels whose sides have lips 46 for retaining cooperating formations 48 of cover trims 50 in a snap-fitting manner. In both types of support post the channels allow for insertion of screw fixings through the foot plates 44 into the base member 12 that are then concealed by the cover trims 50.

The larger scale support posts 14A have their end channels with a base formed by angled facets 52 which are provided to take screws 54 therethrough into the window frames 18. Again these screws are concealed by the cover trims 50.

The base members 12 are also formed as aluminium extrusions of hollow section. Along one edge is a support shelf 53 to which the foot plates of the support posts can be screw fixed. The shelf is intended to be outwards of the glazed wall structure. The shelf 53 extends outwardly from a supporting web 54 that has drainage holes 56 at intervals therealong. Along its opposite edge, the base member has a slot 58 to receive a stepped end of the foot plate 44. That allows the support posts to be mounted on the base member by hooking the stepped end of its foot plate into the slot and then screwing down the other end of the foot plate into the shelf 53. Thus, it is only necessary to screw the foot plates down from one side of the glazed wall structure rather than from both. Thus, erection of the structure may be facilitated.

Intermediate the opposed edges of the base member is a groove 60, which is adapted to receive weather seal material and on which the window frames 18 will sit. Alternatively, the groove 60 could take baffle detail to allow ventilation beneath the window frames.

The base member 12 has a leading edge 64 extending below the shelf 53 and an overhang 66 below the shelf. These two locations are provided to receive a sill member 68 or such other trim as may be appropriate for the substrate on which the base member 12 is supported, i.e. there will be different trims required depending on whether the base member is on a supporting wall or is floor mounted, such as on patio decking.

Figure 9:
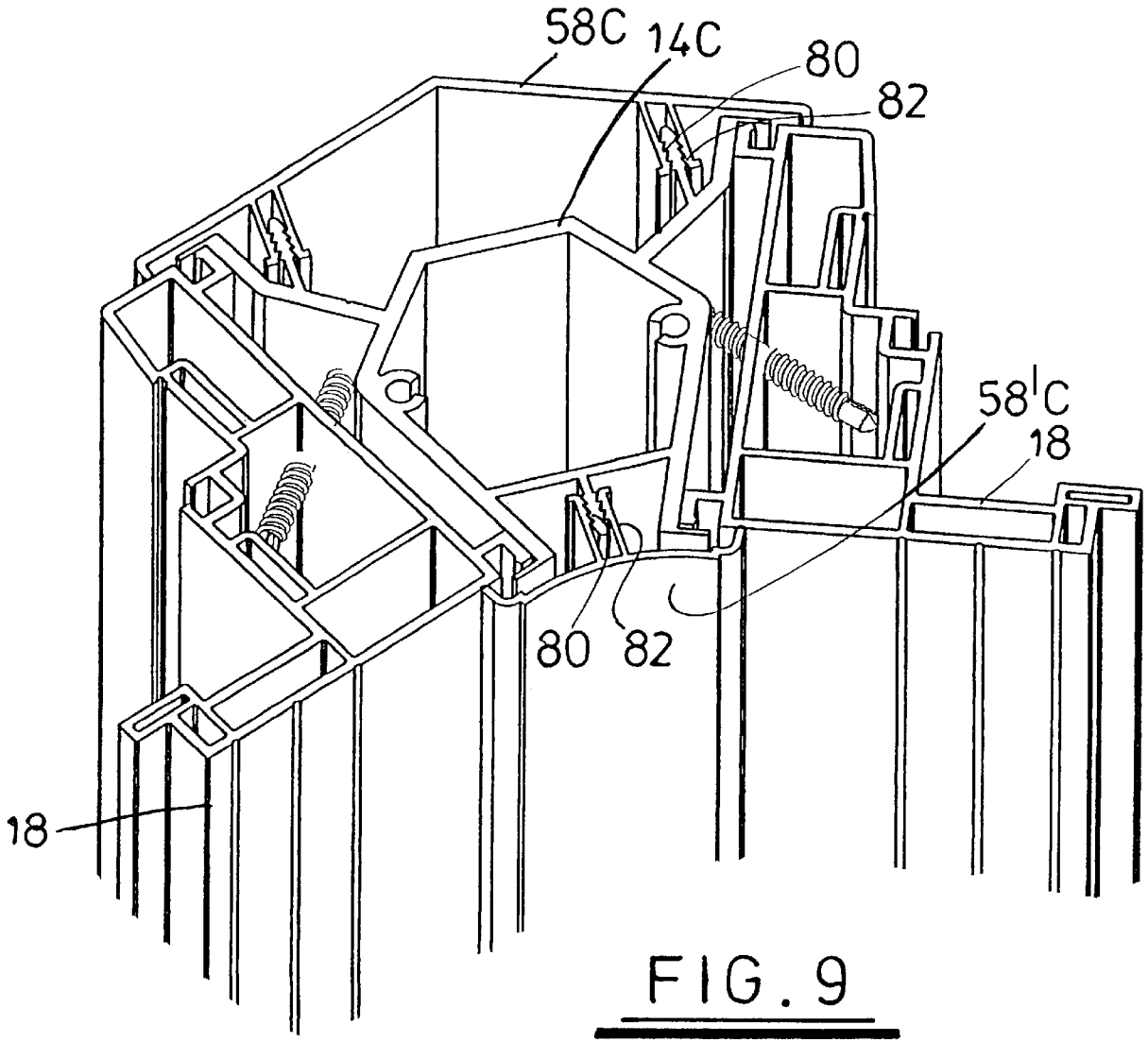
FIGS. 9, 10 and 11 show differently angled corner constructions for the structure of FIG. 1.
Figure 10:
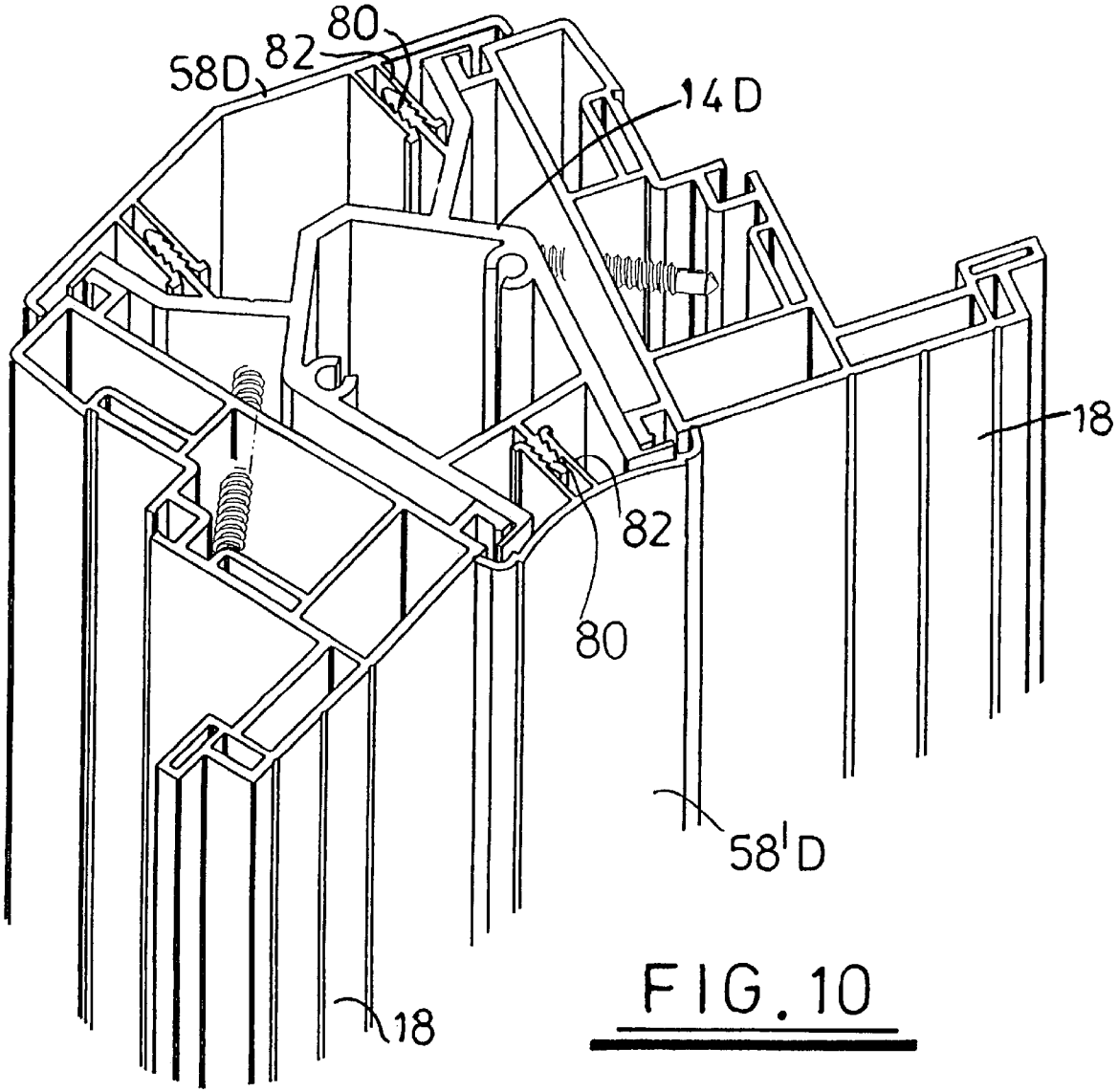
Figure 11:
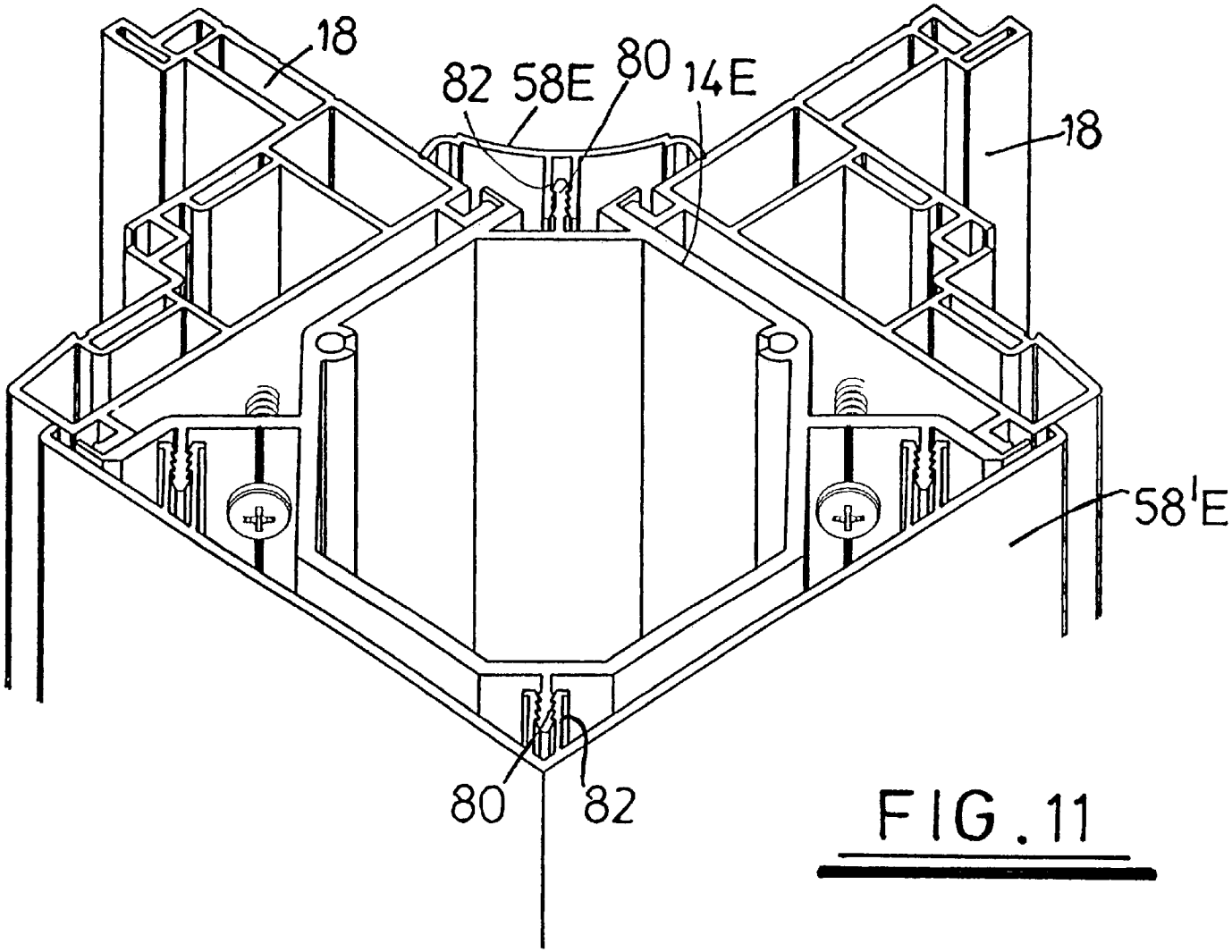

Between the groove 60 and the slot 58 is a channel 70 with returned edges 72, 74 to provide a location for brackets (not shown) used to connect base members end to end especially for forming comers. FIGS. 9, 10 and 11 of the drawings show specialcornersupport posts 14C, 14D and 14E respectively. The posts 14C, 14D and 14E embody similar principles to those of support posts 14A except that different cover trims 58C, 58'C, 58D, 58'D and 58E, 58'E are required and these are fixed by means of fir tree type connectors 80 on the posts fitting slots 82 of the trims.

Where the sill members 68 meet at corners, covers 90 are provided. These have upstands 92 at one end, which fit under a lip 94 along the base member below the shelf 53 and have hook formations 96 at their forward end to fit under the leading edges of the sill members. The covers 90 are able to accommodate thermal expansion or contraction of the sill members 68.

What is claimed is:

1. In a building wall, a combination comprising a window frame and a support post, to which the window frame is fastened and which has an inner side, an outer side, and two lateral sides, wherein the support post has a channel extending along one of the inner and outer sides and defining two lateral walls, through one of which a fastener is driven to fasten the window frame adjacent to whichever of the lateral sides of the post is nearer.

2. The combination of claim 1 wherein the channel is configured so that the lateral walls of the channels flare outwardly toward the side having the channel.

3. The combination of claim 2 wherein the channel is configured so that each of the lateral walls of the channel meets the side having the channel at an obtuse angle.

4. In a building wall, a combination comprising a window frame and a support post, to which the window frame is fastened, and which has an inner side, an outer side, two lateral sides, and two opposite ends, wherein the support post has a channel extending along each of the inner and outer sides, to each of the opposite ends, each channel defining two lateral walls, through one of which a fastener is driven to fasten the window frame adjacent to whichever of the lateral sides of the post is nearer.

5. The combination of claim 4 wherein each channel is configured so that the lateral walls of said channel flare outwardly toward whichever side has said channel.

6. The combination of claim 5 wherein each channel is configured so that each of the lateral walls of said channel meets whichever side has said channel at an obtuse angle.

7. In a building wall, a combination comprising two window frames and a support post, to which the window frames are fastened, and which has an inner side, an outer side, two lateral sides, and two opposite ends, wherein the support post has a channel extending along each of the inner and outer sides, to each of the opposite ends, each channel defining two lateral walls, through each of which a fastener is driven to fasten one of the window frames adjacent to whichever of the lateral sides of the post is nearer.

8. The combination of claim 7 wherein each channel is configured so that the lateral walls of said channel flare outwardly toward whichever side has said channel.

9. The combination of claim 8 wherein each channel is configured so that each of the lateral walls of said channel meets whichever side has said channel at an obtuse angle.

10. The combination of any one of claims 1 through 9 further comprising a base member, on which the support post is mounted.

11. The combination of any one of claims 1 through 9 further comprising an eaves beam, which is mounted on the support post.

* * * * *